US010222152B1

(12) United States Patent
Ayers

(10) Patent No.: US 10,222,152 B1
(45) Date of Patent: Mar. 5, 2019

(54) RELOADABLE MAGAZINE APPARATUS CONFIGURED TO ACCEPT A PLURALITY OF CARTRIDGES

(71) Applicant: Mark Ayers, Los Osos, CA (US)

(72) Inventor: Mark Ayers, Los Osos, CA (US)

( * ) Notice: Subject to any disclaimer, the term of this patent is extended or adjusted under 35 U.S.C. 154(b) by 0 days.

(21) Appl. No.: 15/892,264

(22) Filed: Feb. 8, 2018

(51) Int. Cl.
*F41A 9/67* (2006.01)
*F41A 9/84* (2006.01)
*F41A 9/71* (2006.01)

(52) U.S. Cl.
CPC ..... *F41A 9/67* (2013.01); *F41A 9/71* (2013.01); *F41A 9/84* (2013.01)

(58) Field of Classification Search
CPC ..... F41A 9/65–9/67; F41A 9/71; F41A 9/82–9/84
USPC ..... 42/87–88, 49.01–50
See application file for complete search history.

(56) References Cited

U.S. PATENT DOCUMENTS 1,119,756 A * 12/1914 Howe ..... F41A 17/38 42/50
2,894,350 A * 7/1959 Janson ..... F41A 9/84 42/50
2,910,795 A * 11/1959 Agren ..... F41A 9/67 206/3
3,143,820 A * 8/1964 Lucianetti ..... F41A 9/65 42/50
4,152,857 A * 5/1979 Ketterer ..... F41A 9/65 42/88
4,688,344 A * 8/1987 Kim ..... F41A 9/67 42/50
7,059,077 B2 6/2006 Tal et al.

OTHER PUBLICATIONS

Compmag, http://www.compmag.net (originally retrieved on Feb. 8, 2018).

* cited by examiner

*Primary Examiner* — Stephen Johnson
*Assistant Examiner* — Benjamin S Gomberg
(74) *Attorney, Agent, or Firm* — Arc IP Law, PC; Joseph J. Mayo

(57) ABSTRACT

A reloadable magazine apparatus that accepts two or more cartridges that enables users to quickly load a plurality of cartridges into the magazine through a loading window, for use in a firearm. Embodiments of the invention enable a user to place a clip of cartridges directly in the magazine, for example a stripper clip, and rapidly load the magazine. Embodiments of the invention enable the magazine to be configured for use in capacity and removable magazine restricted states through the incorporation of ammunition stops and locking tabs.

19 Claims, 14 Drawing Sheets

RELOADABLE MAGAZINE APPARATUS CONFIGURED TO ACCEPT A PLURALITY OF CARTRIDGES

BACKGROUND OF THE INVENTION

Field of the Invention

One or more embodiments of the invention are related to the field of firearms and box magazines, and/or cartridge storage and feeding devices. More particularly, but not by way of limitation, one or more embodiments of the invention enable a reloadable magazine apparatus configured to accept a plurality of cartridges, which enables users to quickly, conveniently and effectively load cartridges into a magazine, for example a fixed or non-removable or non-detachable magazine for storage or use in a firearm.

Description of the Related Art

Current solutions for loading cartridges into a magazine require the user to manually push each cartridge into the magazine over the follower, or load the cartridges into some type of speed loader that allows multiple cartridges to be pushed into the magazine with a single push. These solutions are limited in that each cartridge requires individual attention by the user, in order for the cartridges to be loaded properly.

The most popular style of magazine for use in modern rifles, handguns and shotguns with detachable magazines, is the box type magazine. The box type magazine allows cartridges to be loaded from an opening in the top of the magazine. These cartridges are then stacked inside of the box in either single or double stack configurations. With advances in stacking of cartridges, some magazines have gone beyond the single and double stack configurations. After the magazine is loaded into a firearm, a cartridge is pushed out of the magazine, and a spring and follower system pushes the next cartridge to the top of the magazine so it can be inserted into the firearm next.

Most current magazines for storing and feeding cartridges can only accept loaded cartridges through the top opening. A magazine with a singular opening limits the user to a particular way of loading cartridges, which may not be ideal due to other conditions effecting the user.

In the case of currently available magazines that have more than one opening, the user is still required to individually organize the cartridges in rows, which takes time, additional dexterity, and may also not be ideal due to other conditions effecting the user. At least one apparatus requires the user to stack cartridges on top of each other before the front plate is slid back up to the top of the magazine, and does not allow use of stripper clips from the opening in the magazine body. This presents a problem because the stripper clips must still be loaded from the top of the magazine and a stripper clip guide must be used.

To use currently available speed loaders, the user is required to take an extra piece of equipment with them in order to load cartridges in a more efficient manner. But, all cartridges still require individual attention in order for the speed loader to function properly. In the case of U.S. Pat. No. 7,059,077, issued on Jun. 13, 2006, to Tal et al. the user is required to individually load cartridges into an elongated slideway. Each cartridge must be angled to fit under a set of grooves before it can be pushed into the magazine by the slider. While this method of loading cartridges into a magazine does reduce the necessary time to load a magazine, it requires an extra piece of bulky equipment in order to properly load the magazine.

Current available magazines can be loaded with a stripper clip if a stripper clip guide is placed on the top of the magazine or an additional speed loader is used. Again, the user is required to carry additional equipment in order to properly load the magazine. Also, while a line of cartridges is pushed off the stripper clip, the cartridges are still individually loaded because each individual cartridge enters the magazine one at a time.

There is a magazine called CompMag which does not allow the user to load ammunition on a stripper clip. Also, the CompMag cannot eject a stripper clip after the ammunition is removed from the stripper clip.

For at least the limitations described above there is a need for a reloadable magazine apparatus configured to accept a plurality of cartridges.

BRIEF SUMMARY OF THE INVENTION

One or more embodiments described in the specification are related to a reloadable magazine apparatus configured to accept a plurality of cartridges. Specifically, embodiments of the invention include an apparatus to store and feed cartridges that includes a magazine body, a loading window, a follower, and a follower spring. In other embodiments, the loading window may be configured to enable simultaneous entry of a plurality of cartridges into the magazine body through the loading window. In other embodiments, the follower may be configured to accept the plurality of cartridges through the loading window. The follower spring may be configured to move the plurality of cartridges on the magazine follower into the firearm.

In one or more embodiments of the invention, the magazine body may be configured to couple with a dust cover. In these embodiments the dust cover may be the same shape as the magazine body, or any fraction thereof. Embodiments of the invention do not require a dust cover however.

In one or more embodiments of the invention, where the magazine body is configured to couple with a dust cover, the magazine body may further comprise at least one dust cover slot. In these embodiments the at least one dust cover slot aids in coupling the dust cover to the magazine body. In these embodiments the placement of the dust cover slots can be anywhere along the magazine body. Any number of dust cover slots may be utilized based on the needs of the user. The dust cover, when coupled with the dust cover slots, can also add addition structural rigidity to the magazine body. Embodiments of the invention do not require dust cover slots however.

In one or more embodiments of the invention, the magazine body may be configured to accept the plurality of cartridges in a single stack configuration. In one or more embodiments other stack configurations may be utilized. In these embodiments, the stack configurations can be one, two or any additional increment thereof.

In one or more embodiments of the invention, the reloadable magazine apparatus capable of accepting a plurality of cartridges further comprises an ammunition stop. This configuration restricts the capacity of the reloadable magazine apparatus to a predetermined number of cartridges. Cartridges in excess of the predetermined number of cartridges are unable to enter the magazine body. This cartridge restriction may be set to allow magazines to comply with cartridge capacity restrictions or set to any number of predetermined cartridges. Embodiments of the invention do not require a cartridge stop however.

In one or more embodiments of the invention, where the reloadable magazine apparatus capable of accepting a plurality of cartridges comprises a cartridge stop, the follower may be prevented from pushing the plurality of cartridges from the magazine body into the firearm until the cartridge stop is inserted into the magazine body. Embodiments of the invention do not require the cartridge stop to be inserted for proper functionality however.

In one or more embodiments of the invention, the follower may be configured to accept a clip containing the plurality of cartridges through the loading window. Embodiments of the invention do not require a configuration capable of accepting a clip however.

In one or more embodiments of the invention, where the follower is configured to accept a clip, the magazine body may further comprise a clip stop pin coupled to the magazine body. The clip stop pin restricts the movement of the clip in the magazine body when the follower is pushed towards the firearm so the plurality of cartridges can be loaded into the firearm. Embodiments of the invention configured to accept a clip or otherwise, do not require the clip stop pin however.

In one or more embodiments of the invention the magazine raceway comprises at least one magazine raceway. Embodiments of the invention may utilize any number of raceways to ensure proper function of the invention.

In one or more embodiments of the invention the magazine raceway comprises a plurality of magazine raceways. Embodiments of the invention may utilize any number of raceways to ensure proper function of the invention.

In one or more embodiments of the invention, the follower further comprises a follower pin that protrudes from the follower through the at least one magazine raceway. Embodiments of the invention do not require a follower pin however.

In one or more embodiments of the invention, the follower further comprises a plurality of follower pins. Embodiments of the invention do not require a plurality of follower pins however.

In one or more embodiments of the invention, the magazine body further comprises at least one locking tab. The locking tab restricts the removal of the reloadable magazine apparatus from the firearm. This feature may create a fixed magazine that will allow use of firearms in restricted areas. Embodiments of the invention do not require at least one locking tab however.

BRIEF DESCRIPTION OF THE DRAWINGS

The above and other aspects, features and advantages of the invention will be more apparent from the following more particular description thereof, presented in conjunction with the following drawings wherein.

DETAILED DESCRIPTION OF THE INVENTION

A reloadable magazine apparatus configured to accept a plurality of cartridges will now be described. In the following exemplary description numerous specific details are set forth in order to provide a more thorough understanding of embodiments of the invention. It will be apparent, however, to an artisan of ordinary skill that the present invention may be practiced without incorporating all aspects of the specific details described herein. In other instances, specific features, quantities, or measurements well known to those of ordinary skill in the art have not been described in detail so as not to obscure the invention. Readers should note that although examples of the invention are set forth herein, the claims, and the full scope of any equivalents, are what define the metes and bounds of the invention.

Figure 1A:
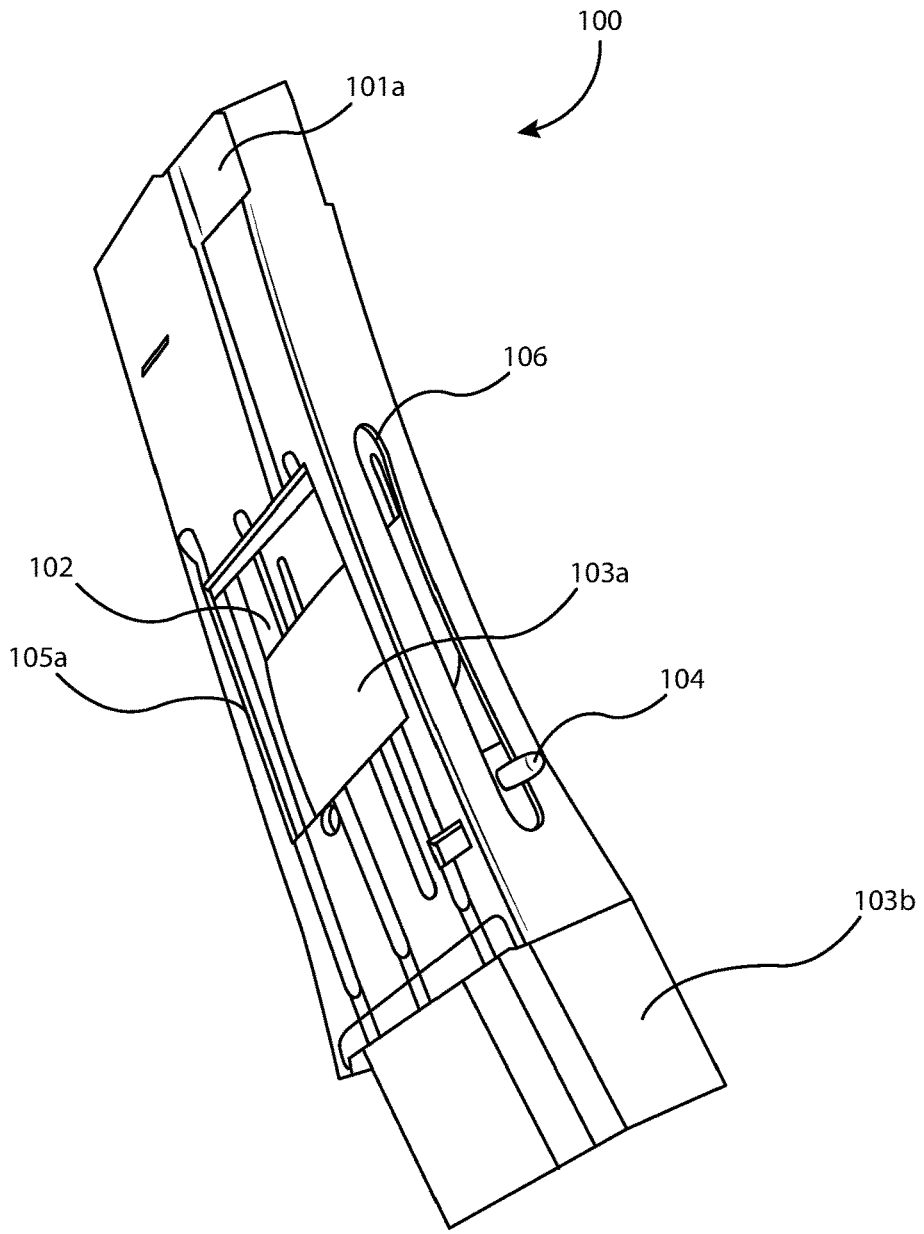
FIG. 1A illustrates a perspective view of at least one embodiment of the reloadable magazine apparatus configured to accept a plurality of cartridges with a follower that protrudes from the magazine body.

FIG. 1A shows a perspective view of reloadable magazine apparatus 100 that is configured to accept a plurality of cartridges that includes a magazine body 101*a*, loading window 102, ammunition stop 103*a*, follower 103*b*, at least one follower pin 104, at least one dust cover coupling point 105*a*, and magazine raceway 106. The follower 103*b* is shown protruding from the magazine body 101*a* which allows the user to pull the follower 103*b* down so that cartridges can be loaded in the magazine body 101*a* through the loading window 102. The follower 103*b* may be coupled with ammunition stop 103*a* and/or at least one follower pin 104. The ammunition stop 103*a* may be removed from the follower 103*b*, in order to allow the user to restrict the capacity of the reloadable magazine apparatus 100 to a predetermined number of cartridges. Embodiments of the invention may restrict the movement of cartridges in to the firearm, if ammunition stop 103*a* is not coupled with the follower 103*b*. The at least one dust cover coupling point 105*a* may be in the loading window 102 and/or any other part of magazine body 101*a*. The magazine raceway may allow at least one follower pin 104 to protrude from magazine body 101*a*. Embodiments of the invention may enclose the magazine raceway 106 in the magazine body 101*a*.

Figure 1B:
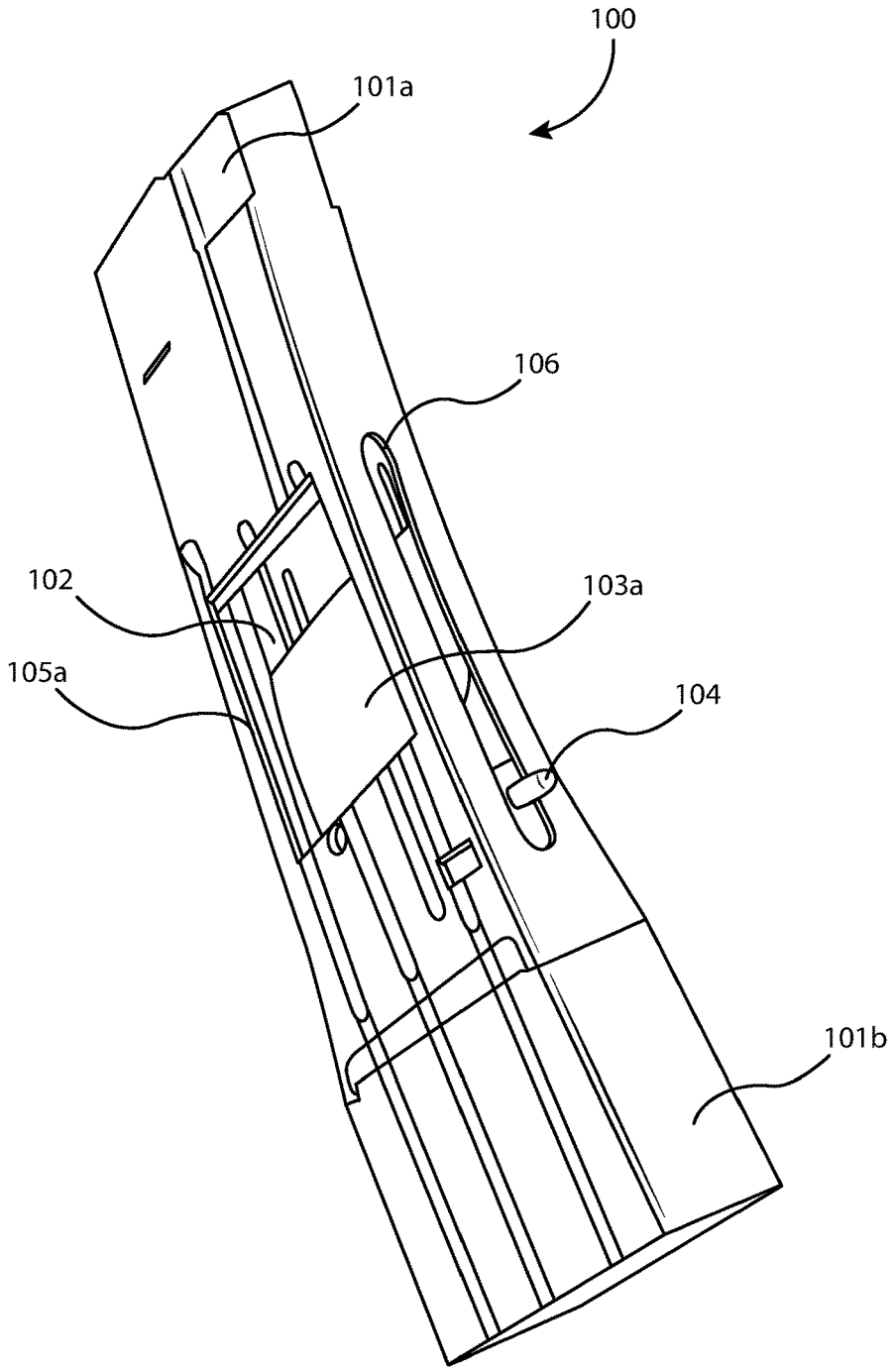
FIG. 1B illustrates a perspective view of at least one embodiment of the reloadable magazine apparatus configured to accept a plurality of cartridges with a follower that is contained in the magazine body.

Alternatively, FIG. 1B shows another embodiment of the reloadable magazine apparatus 100 configured to accept a plurality of cartridges where the magazine body 101*a* includes bottom 101*b* that covers the follower 103*b* (shown in FIG. 1A).

Figure 2A:
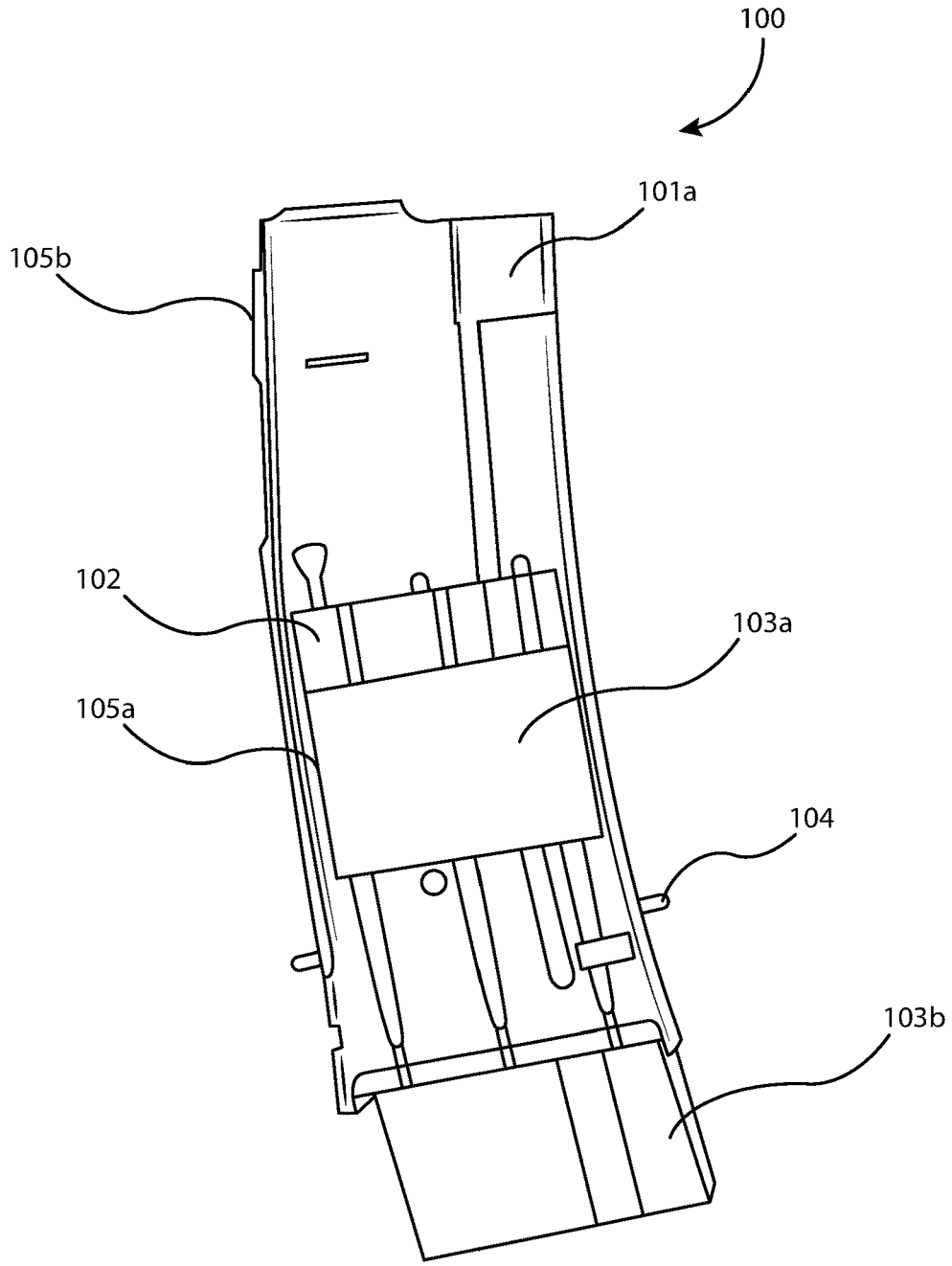
FIG. 2A illustrates a front view of at least one embodiment of the reloadable magazine apparatus configured to accept a plurality of cartridges with a follower that protrudes from the magazine body.

FIG. 2A shows a front view of reloadable magazine apparatus 100 that includes magazine body 101*a*, loading window 102, ammunition stop 103*a*, follower 103*b*, at least one follower pin 104, and at least one dust cover coupling point 105*a*. Additional dust cover coupling points are shown by 105*a* and 105*b*. Additional dust cover coupling points may be coupled to the magazine body 101*a*. The follower 103*b* is shown protruding from the magazine body 101*a*. In this embodiment, there is a gap between magazine body 101*a* and follower 103*b* wherein a stripper clip can move through when moving follower 103*b* to load the magazine 100, by disengaging the ammunition from the stripper clip. The gap between the magazine body 101*a* and follower 103*b* is predefined to allow the follower 103*b* to travel towards the firearm, while the stripper clip remains stationary. Also, in embodiments with a bottom 101*b*, a stripper clip exit hole 601 (shown in FIG. 6) can be included to enable the stripper clip to exit the magazine body 101*a*. Embodiments of the invention may utilize the structure of magazine body 101*a* to keep the stripper clip from moving towards the mouth of the reloadable magazine apparatus 100.

Figure 2B:
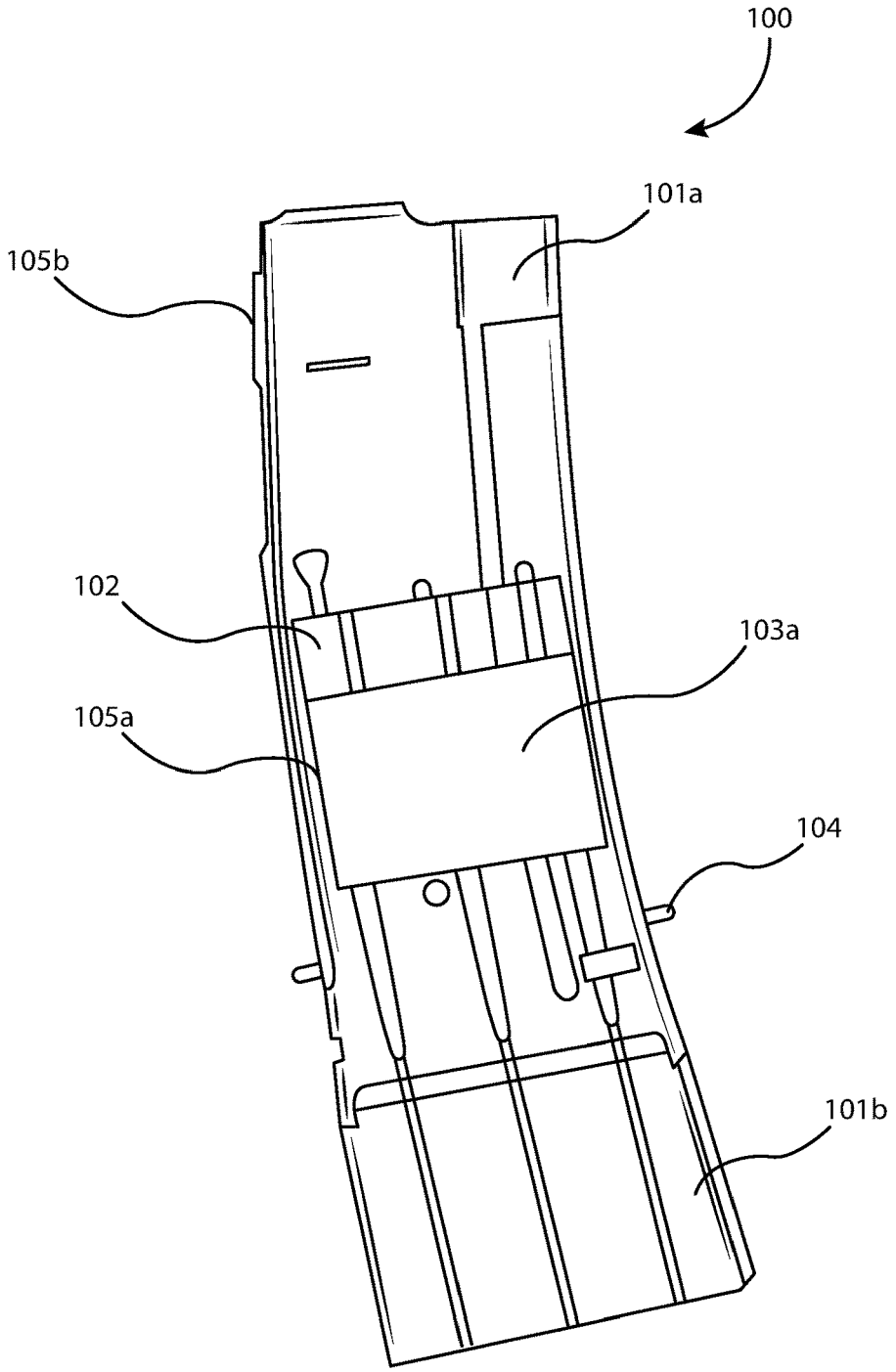
FIG. 2B illustrates a front view of at least one embodiment of the reloadable magazine apparatus configured to accept a plurality of cartridges with a follower that is contained in the magazine body.

Alternatively, FIG. 2B shows another embodiment of the reloadable magazine apparatus 100 configured to accept a plurality of cartridges where the magazine body 101*a* includes bottom 101*b* that covers the follower 103*b* (shown in FIG. 2A).

Figure 3A:
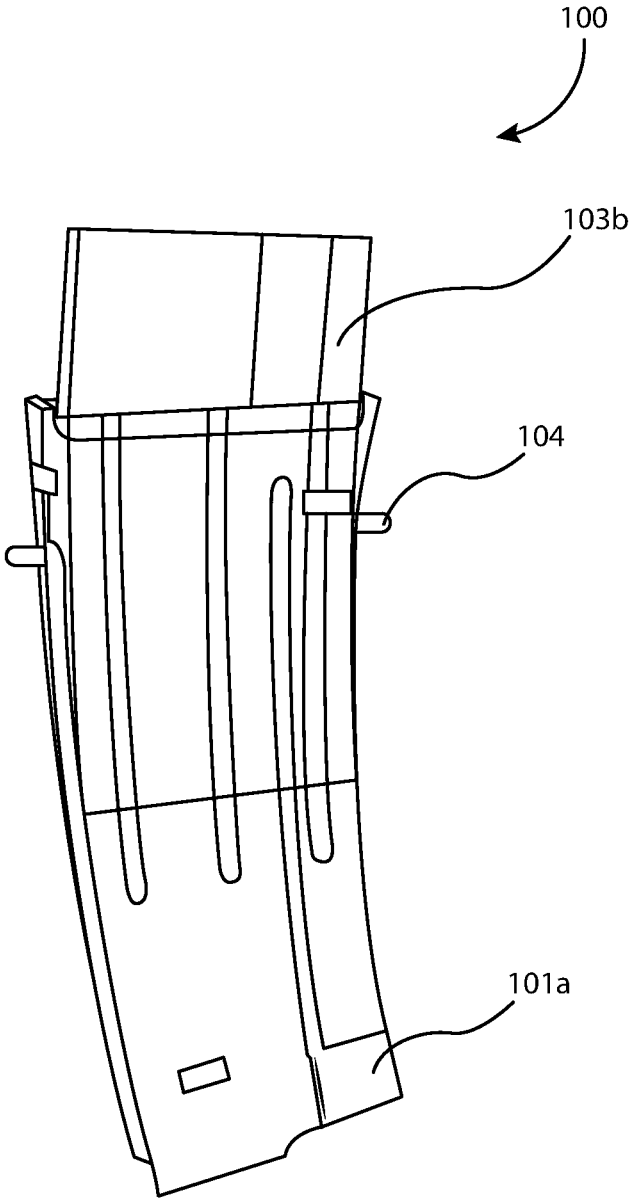
FIG. 3A illustrates an inverted rear perspective view of at least one embodiment of the reloadable magazine apparatus configured to accept a plurality of cartridges with a follower that protrudes from the magazine body.

FIG. 3A shows an inverted rear perspective view of reloadable magazine apparatus 100 that includes magazine body 101*a*, follower 103*b*, and at least one follower pin 104. The follower 103*b* is shown protruding from the magazine body 101*a*.

Figure 3B:
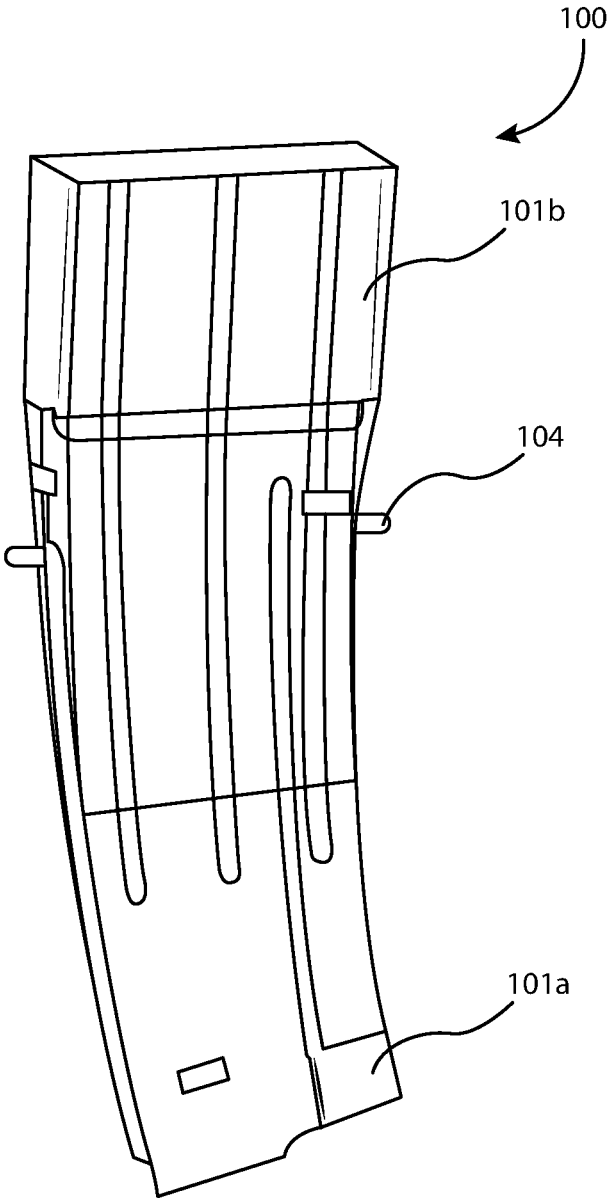
FIG. 3B illustrates an inverted rear perspective view of at least one embodiment of the reloadable magazine apparatus configured to accept a plurality of cartridges with a follower that is contained in the magazine body.

Alternatively, FIG. 3B shows another embodiment of the reloadable magazine apparatus 100 configured to accept a plurality of cartridges where the magazine body 101*a* includes bottom 101*b* that covers the follower 103*b* (shown in FIG. 3A).

Figure 4A:
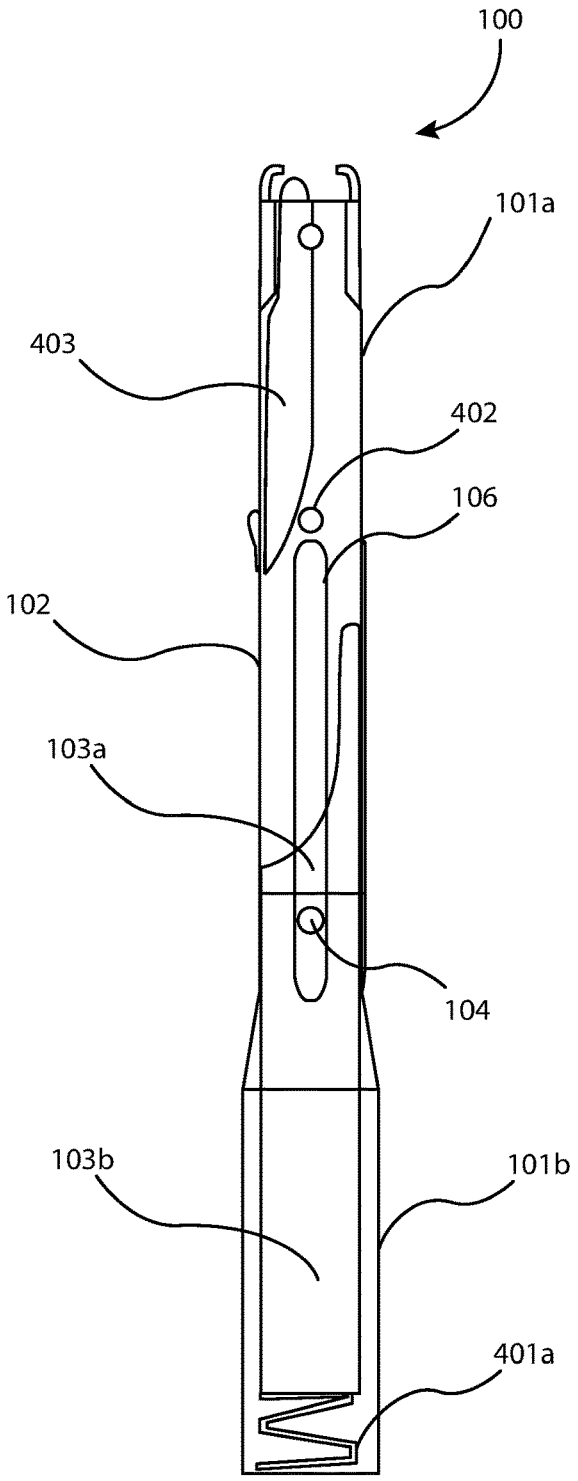
FIG. 4A illustrates a right view of at least one embodiment of the reloadable magazine apparatus configured to accept a plurality of cartridges with the follower spring shown.

FIG. 4A shows a right view of reloadable magazine apparatus 100 that is configured to accept a plurality of cartridges that includes a magazine body 101*a*, bottom 101*b*, loading window 102, ammunition stop 103*a*, follower 103*b*, at least one follower pin 104, magazine raceway 106, follower spring 401*a*, clip stop pin 402, and cartridge guide 403. Embodiments of the invention may be made with plastic that is clear for example so that internal parts are visible. Other embodiments may be made from metal or other materials including composites that may or may not enable viewing of the internal components. The follower spring 401*a* may be a wire spring, flat spring, or any type of spring known to those of ordinary skill in the art. A wire type follower spring 401*a* is shown. The clip stop pin 402 is coupled to the magazine body 101*a*, to prevent clips of cartridges from being pushed into the firearm. The cartridge guide 403 enables the reloadable magazine apparatus 100 to operate in a single stack configuration. Embodiments of the invention may remove the cartridge guide 403 to enable the reloadable magazine apparatus 100 to operate in a double stack configuration.

Figure 4B:
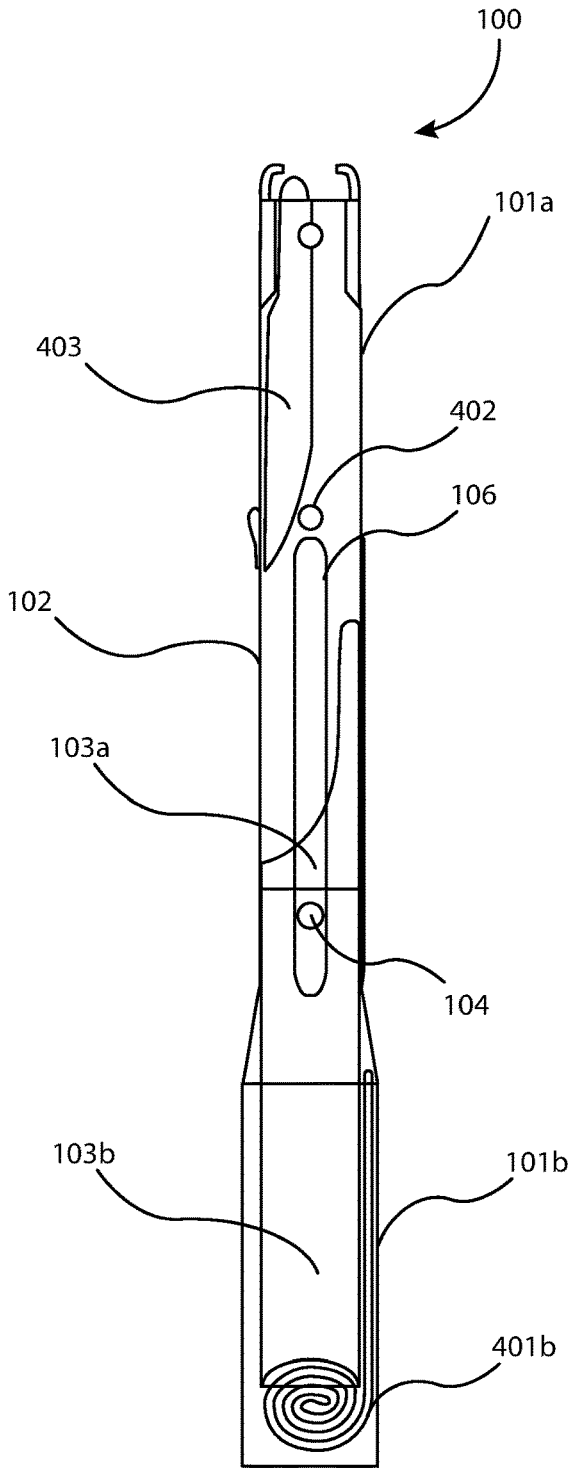
FIG. 4B illustrates a right view of at least one embodiment of the reloadable magazine apparatus configured to accept a plurality of cartridges with the follower spring shown.

Alternatively, FIG. 4B shows another embodiment of the reloadable magazine apparatus 100 configured to accept a plurality of cartridges where the follower spring 401*a* is shown as a flat spring or ribbon spring 401*b*.

Figure 5A:
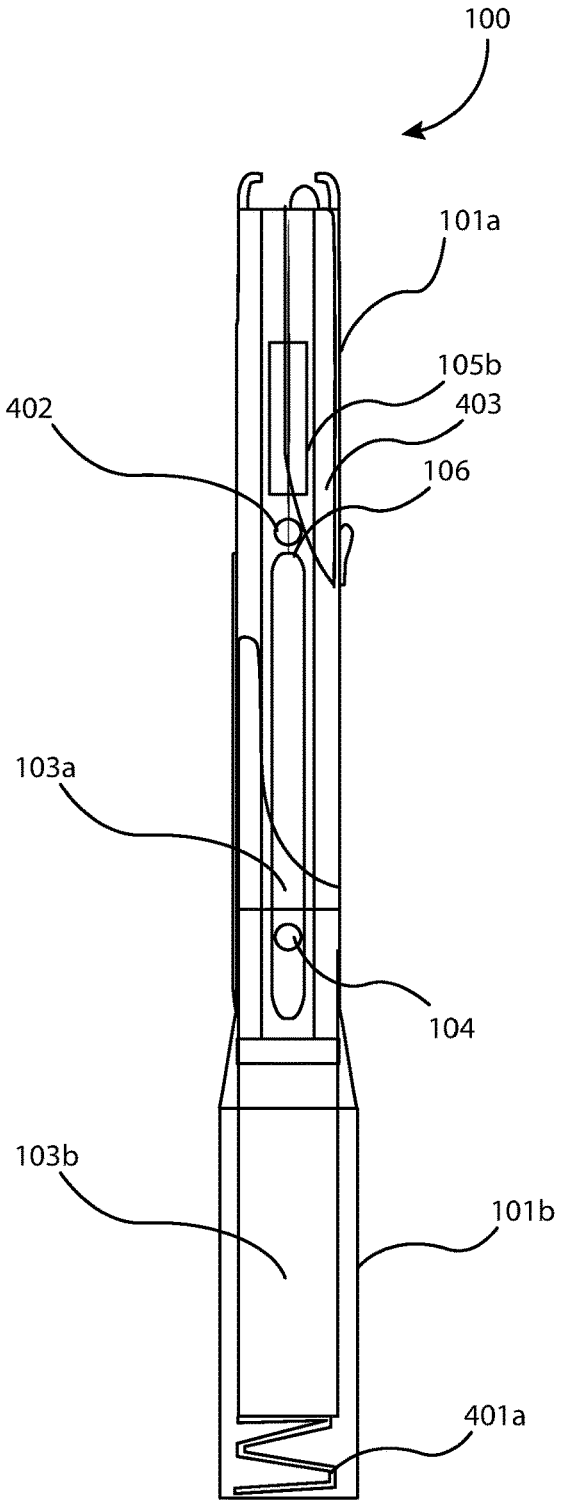
FIG. 5A illustrates a left view of at least one embodiment of the reloadable magazine apparatus configured to accept a plurality of cartridges with the follower spring shown.

FIG. 5A shows a left view of reloadable magazine apparatus 100 that is configured to accept a plurality of cartridges that includes a magazine body 101*a*, bottom 101*b*, loading window 102, ammunition stop 103*a*, follower 103*b*, at least one follower pin 104, at least one dust cover coupling point 105*b*, magazine raceway 106, follower spring 401*a*, clip stop pin 402, and cartridge guide 403. A wire type follower spring 401*a* is shown.

Figure 5B:
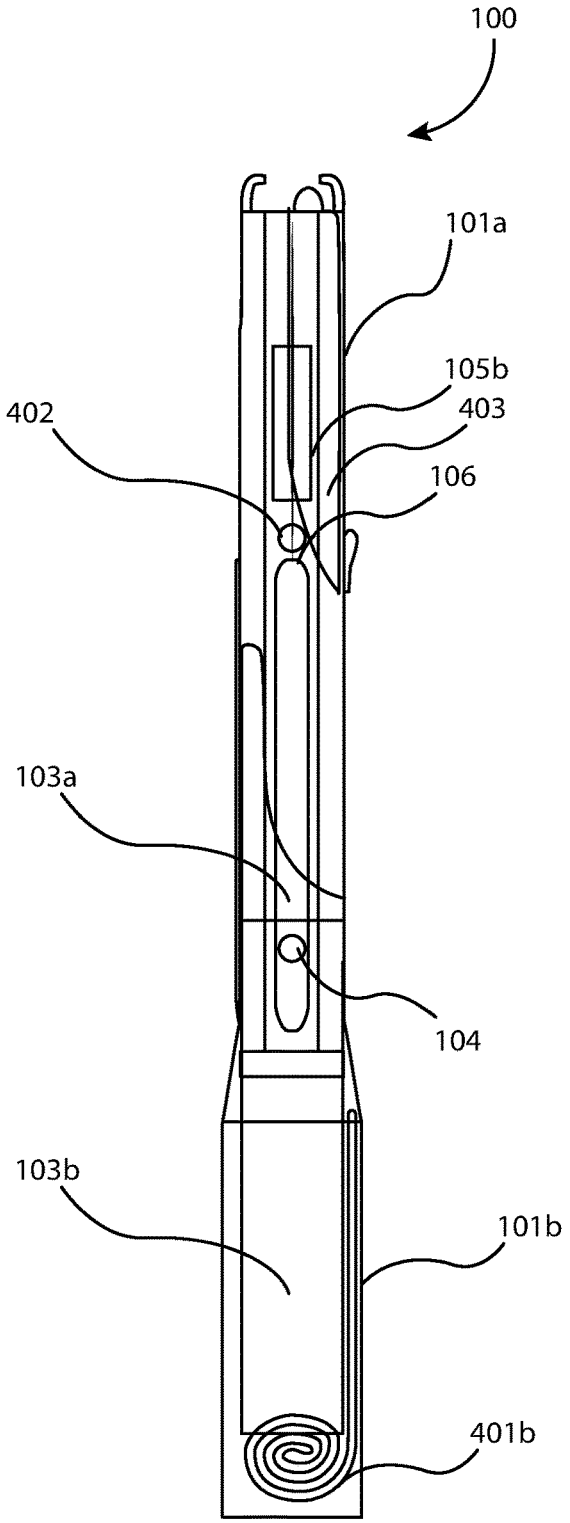
FIG. 5B illustrates a left view of at least one embodiment of the reloadable magazine apparatus configured to accept a plurality of cartridges with the follower spring shown.

Alternatively, FIG. 5B shows another embodiment of the reloadable magazine apparatus 100 configured to accept a plurality of cartridges where the follower spring 401*a* is shown as a flat spring.

Figure 6:
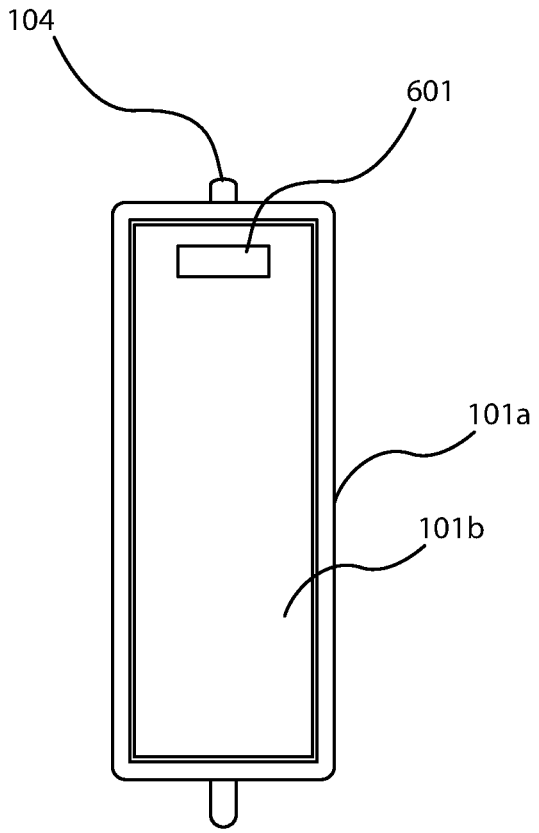
FIG. 6 illustrates a bottom view of at least one embodiment of the reloadable magazine apparatus.

FIG. 6 shows a bottom view of magazine body 101*a*, at least one follower pin 104, and stripper clip exit hole 601. In this embodiment, a stripper clip exit hole 601 is shown in bottom 101*b* to enable a stripper clip to exit the magazine when the follower 103*b* moves towards the firearm, which removes the ammunition from the stripper clip.

Figure 7A:
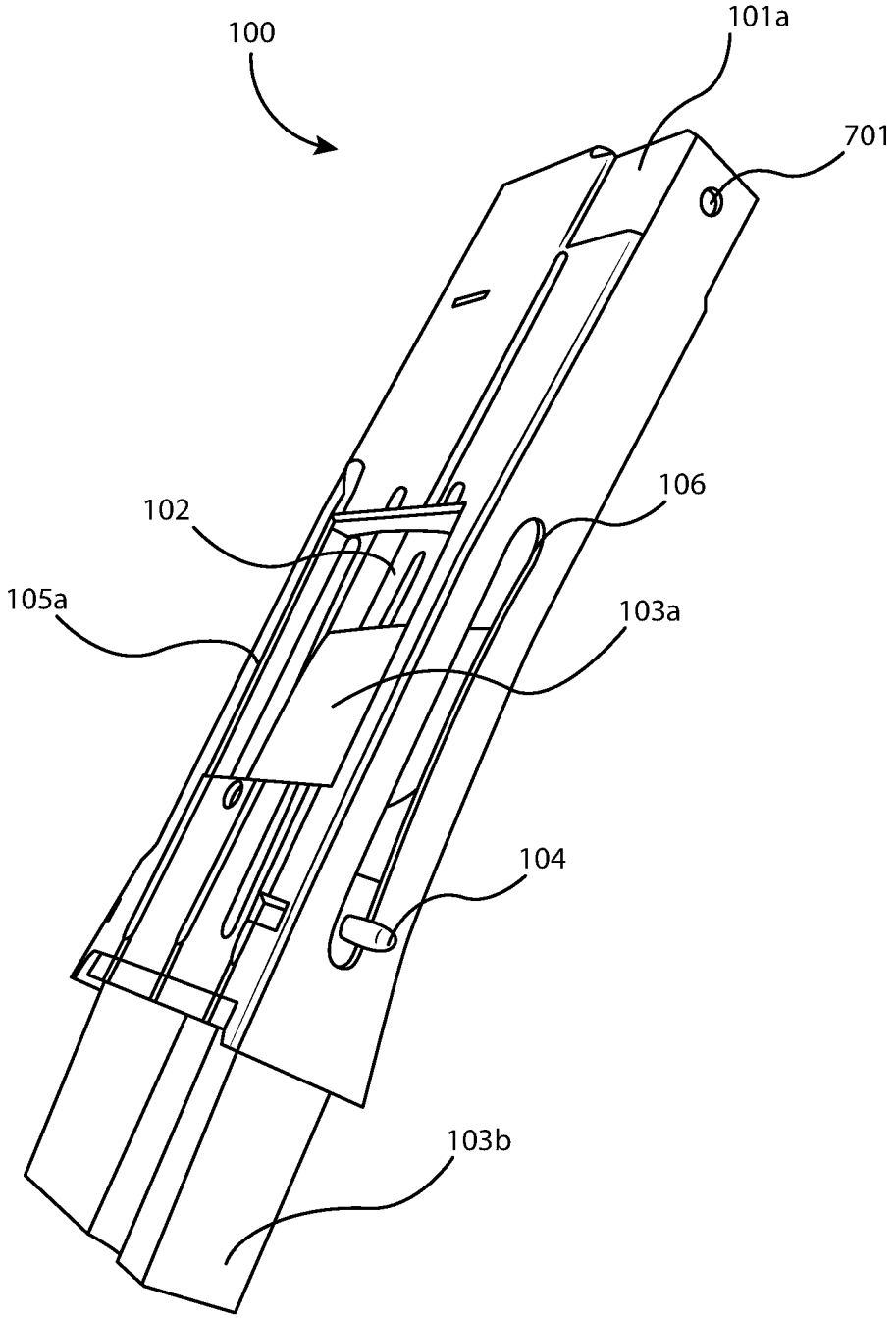
FIG. 7A illustrates a front perspective view of at least one embodiment of the reloadable magazine apparatus configured to accept a plurality of cartridges with a follower that protrudes from the magazine body.

FIG. 7A shows a front perspective view of reloadable magazine apparatus 100 that includes magazine body 101*a*, bottom 101*b*, loading window 102, ammunition stop 103*a*, follower 103*b*, at least one follower pin 104, at least one dust cover coupling point 105*a*, magazine retention hole 701. The follower 103*b* is shown protruding from the magazine body 101*a*. In this embodiment of the invention, a magazine retention hole 701 is shown to enable the reloadable magazine apparatus 100 to couple to a variety of firearms.

Figure 7B:
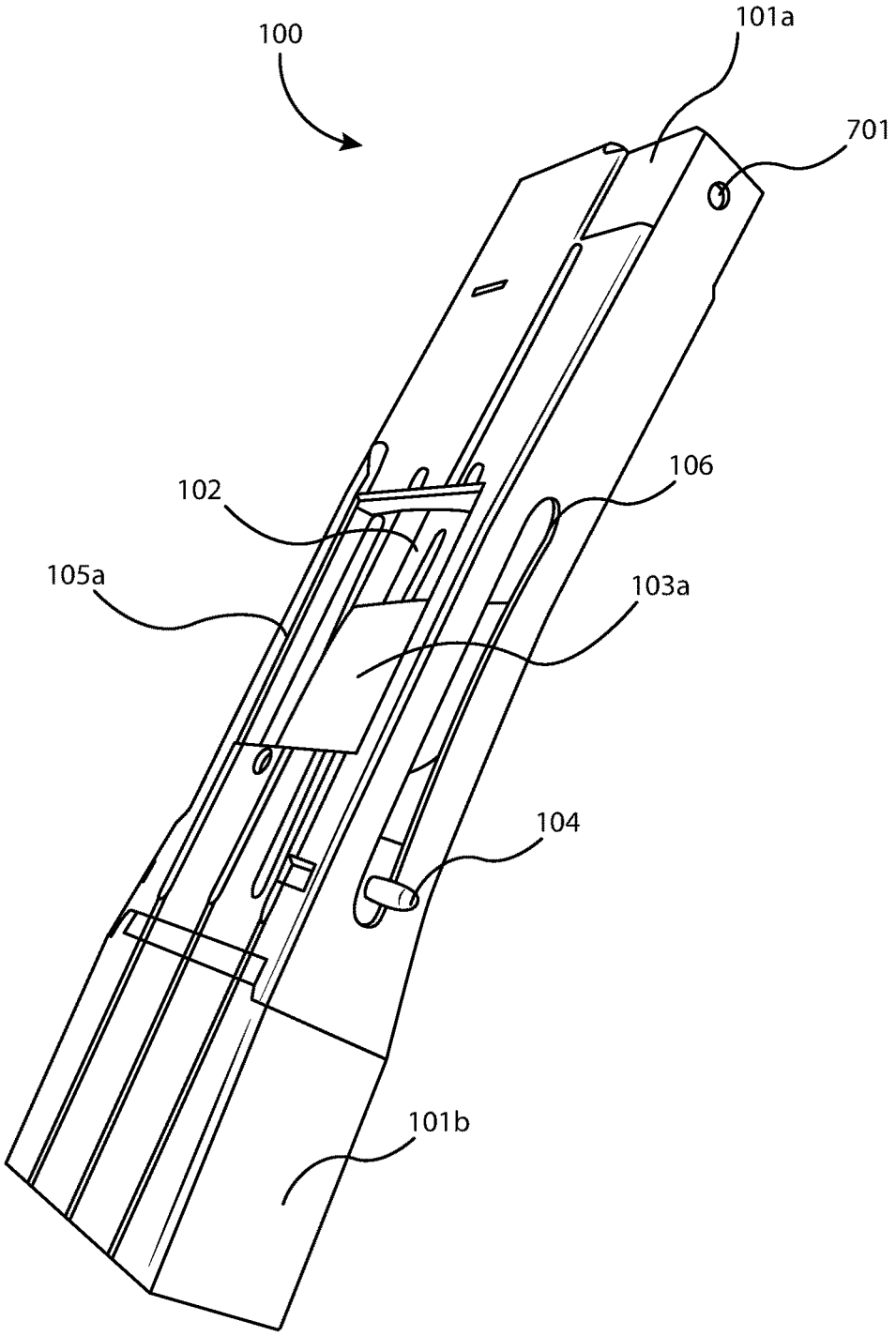
FIG. 7B illustrates a front perspective view of at least one embodiment of the reloadable magazine apparatus configured to accept a plurality of cartridges with a follower that is contained in the magazine body.

Alternatively, FIG. 7B shows another embodiment of the reloadable magazine apparatus 100 configured to accept a plurality of cartridges where the magazine body 101*a* includes bottom 101*b* that covers the follower 103*b* (shown in FIG. 7A)

Figure 8:
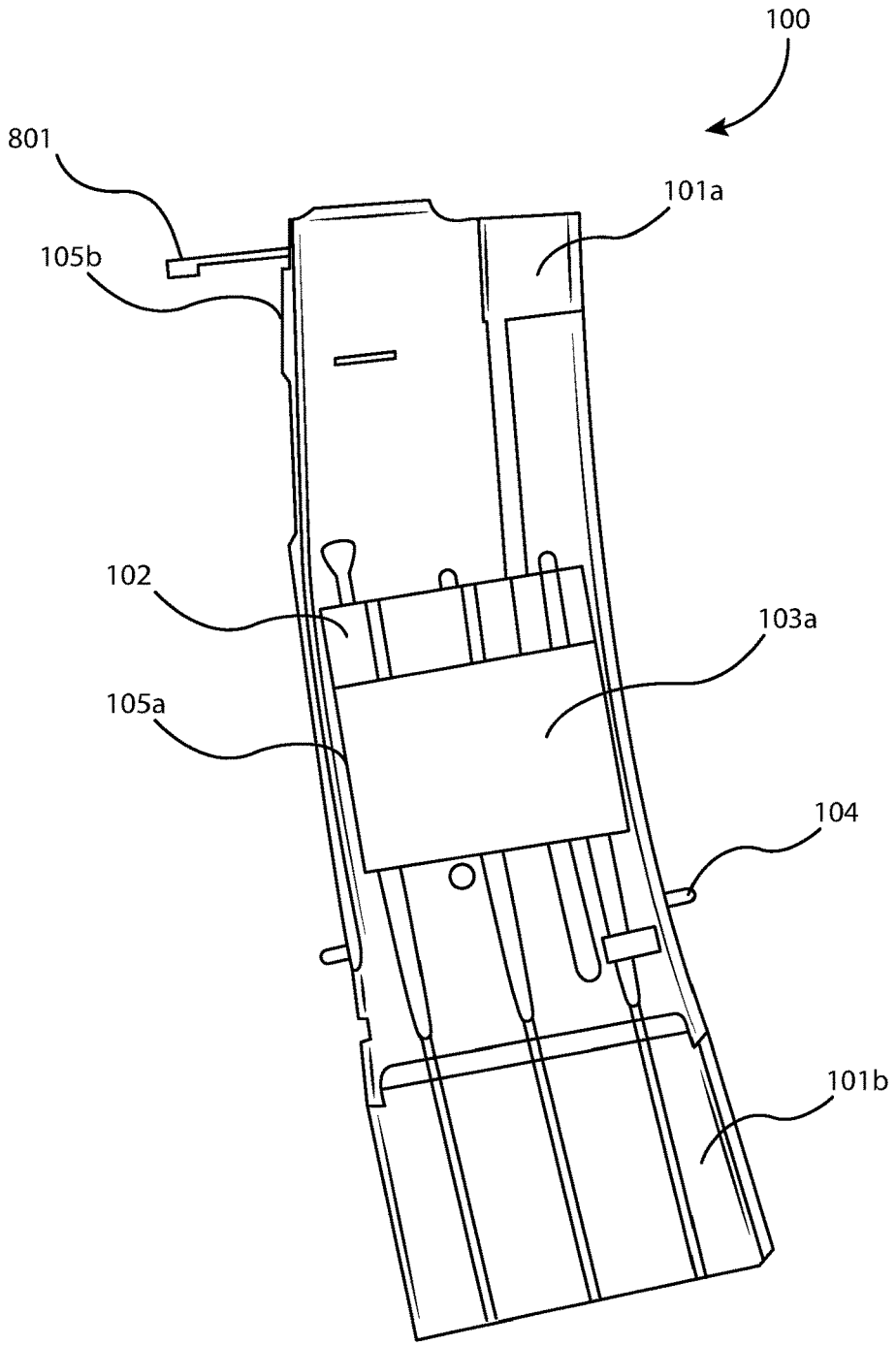
FIG. 8 illustrates a front view of at least one embodiment of the reloadable magazine apparatus configured to accept a plurality of cartridges with a follower that is contained in the magazine body and a locking tab.

FIG. 8 shows a front view of reloadable magazine apparatus 100 that includes magazine body 101*a*, bottom 101*b*, loading window 102, ammunition stop 103*a*, follower 103*b*, at least one follower pin 104, at least one dust cover coupling point 105*a*, at least one dust covering point 105*b*, and locking tab 801. Locking tab 801 enables the magazine to couple with the firearm to make the magazine non-removable. Any other mechanism that couples the magazine to the firearm so that either a tool or disassembly of the action or firearm is require to remove the magazine may be utilized. Additional dust cover coupling points may be coupled to the magazine body 101*a*. The magazine body 101*a* is show with bottom 101*b* covering the follower 103*b*. Embodiments of the invention may change the number, size, and position of the locking tab 801 to ensure proper operation with the intended firearm.

While the invention herein disclosed has been described by means of specific embodiments and applications thereof, numerous modifications and variations could be made thereto by those skilled in the art without departing from the scope of the invention set forth in the claims.

What is claimed is:

1. A reloadable magazine apparatus configured to accept a plurality of cartridges comprising:

a magazine body configured to couple to a firearm;

wherein the magazine body comprises a loading window configured to enable simultaneous entry of the plurality of cartridges into the magazine body through the loading window;

a follower coupled inside the magazine body;

wherein the follower is configured to accept the plurality of cartridges through the loading window; and wherein the follower is configured to accept a clip containing the plurality of cartridges through the loading window;

a follower spring coupled to the follower;

wherein the follower spring is configured to move the plurality of cartridges on the follower into the firearm; and, wherein the magazine body further comprises a clip stop pin coupled to the magazine body configured to prevent the clip containing the plurality of cartridges from moving into the firearm and wherein said magazine body comprises a clip exit hole that enables said clip to exit said magazine body.

2. The reloadable magazine apparatus of claim 1, wherein the magazine body further comprises at least one dust cover coupling point in the magazine body.

3. The reloadable magazine apparatus of claim 1, wherein the magazine body is configured to accept the plurality of cartridges in a single stack configuration.

4. The reloadable magazine apparatus of claim 1, wherein the magazine body is configured to accept the plurality of cartridges in a double stack configuration.

5. The reloadable magazine apparatus of claim 1, wherein the follower further comprises an ammunition stop configured to restrict introduction of the plurality of cartridges into the magazine body in excess of a predetermined number of cartridges.

6. The reloadable magazine apparatus of claim 5, wherein the follower is configured to prevent the plurality of cartridges from being moved into the firearm until the ammunition stop is inserted into the magazine body.

7. The reloadable magazine apparatus of claim 1, wherein said clip is a stripper clip.

8. The reloadable magazine apparatus of claim 1, wherein the magazine body further comprises at least one magazine raceway.

9. The reloadable magazine apparatus of claim 8, wherein the follower further comprises at least one follower pin that protrudes from the follower through the at least one magazine raceway.

10. The reloadable magazine apparatus of claim 9, wherein the at least one follower pin comprises a plurality of follower pins.

11. The reloadable magazine apparatus of claim 8, wherein the at least one magazine raceway comprises a plurality of magazine raceways.

12. The reloadable magazine apparatus of claim 1, wherein the magazine body further comprises at least one locking tab.

13. A reloadable magazine apparatus of cartridges comprising:

a magazine body configured to couple to a firearm;

the magazine body comprising a loading window configured to enable simultaneous entry of the plurality of cartridges into the magazine body through the loading window;

a follower coupled inside the magazine body;

wherein the follower is configured to accept the plurality of cartridges through the loading window; and wherein the follower is configured to accept a clip containing the plurality of cartridges through the loading window;

a clip stop pin coupled to the magazine body;

wherein the clip stop pin is configured to push the clip containing the plurality of cartridges out of the magazine body when the follower is pushed toward the firearm;

a follower spring coupled to the follower;

wherein the follower spring is configured to move the plurality of cartridges on the follower into the firearm;

at least one magazine raceway in the magazine body; and at least one follower pin;

wherein the at least one follower pin protrudes through the at least one magazine raceway to protrude from the magazine body.

14. The reloadable magazine apparatus of claim 13, wherein the magazine body further comprises at least one dust cover coupling point in the magazine body.

15. The reloadable magazine apparatus of claim 13, wherein the magazine body is configured to accept the plurality of cartridges in a single stack configuration.

16. The reloadable magazine apparatus of claim 13, wherein the magazine body is configured to accept the plurality of cartridges in a double stack configuration.

17. The reloadable magazine apparatus of claim 13, wherein the follower further comprises an ammunition stop configured to restrict introduction of the plurality of cartridges into the magazine body in excess of a predetermined number of cartridges.

18. The reloadable magazine apparatus of claim 17, wherein the follower is configured to prevent the plurality of cartridges from being moved into the firearm until the ammunition stop is inserted into the magazine body.

19. The reloadable magazine apparatus of claim 13, wherein the magazine body further comprises at least one locking tab.

* * * * *